US010392154B2

(12) United States Patent
Burgos Agudo

(10) Patent No.: US 10,392,154 B2
(45) Date of Patent: Aug. 27, 2019

(54) PROCEDURE FOR MANUFACTURING A LAMINATED PACKAGE FOR SOLID PRODUCTS IN POWDER OR GRAIN FORM, AS WELL AS A PACKAGE OBTAINED BY THIS PROCEDURE

(71) Applicant: Luís Burgos Agudo, Puerto de Sagunto (ES)

(72) Inventor: Luís Burgos Agudo, Puerto de Sagunto (ES)

(73) Assignee: Lubuag Ltd., Sea Port, Victoria, Mahe, Syechelles ( * ) Notice: Subject to any disclaimer, the term of this patent is extended or adjusted under 35 U.S.C. 154(b) by 452 days.

(21) Appl. No.: 15/147,184

(22) Filed: May 5, 2016

(65) Prior Publication Data

US 2017/0320617 A1 Nov. 9, 2017

(51) Int. Cl.

| | |
|---|---|
| ***B65D 5/44*** | (2006.01) |
| ***B65D 75/58*** | (2006.01) |
| ***B65B 1/02*** | (2006.01) |
| ***B65B 7/20*** | (2006.01) |
| ***B31B 50/84*** | (2017.01) |
| ***B65B 31/00*** | (2006.01) |
| ***B65B 51/22*** | (2006.01) |
| ***B65B 61/20*** | (2006.01) |
| ***B65D 77/22*** | (2006.01) |
| ***B65D 83/06*** | (2006.01) |
| ***B65D 5/72*** | (2006.01) |
| ***B65D 5/74*** | (2006.01) |

(Continued)

(52) U.S. Cl.

CPC ..... *B65D 5/443* (2013.01); *B31B 50/84* (2017.08); *B65B 1/02* (2013.01); *B65B 7/20* (2013.01); *B65B 31/00* (2013.01); *B65B 51/225* (2013.01); *B65B 61/20* (2013.01); *B65D 5/721* (2013.01); *B65D 5/746* (2013.01); *B65D 75/5877* (2013.01); *B65D 77/225* (2013.01); *B65D 81/2076* (2013.01); *B65D 83/06* (2013.01); *B65B 31/047* (2013.01)

(58) Field of Classification Search

CPC .. B65D 5/443; B65D 75/5877; B65D 77/225; B65D 83/06; B65D 5/721; B65D 5/746; B65D 81/2076; B65B 1/02; B65B 7/20; B65B 31/00; B65B 51/225; B65B 61/20; B65B 31/047; B31B 50/84

See application file for complete search history.

(56) References Cited

U.S. PATENT DOCUMENTS 4,082,187 A * 4/1978 Carlson ..... B65D 25/107 206/454

4,314,642 A 2/1982 Dagostine (Continued)

FOREIGN PATENT DOCUMENTS

EP 2474479 A1 7/2012

*Primary Examiner* — David J Walczak

(74) *Attorney, Agent, or Firm* — Richard M. Goldberg

(57) ABSTRACT

A laminated package for solid products in powder or grain form, includes a set of stiffening notches, a dispensing mouth with a seal, valves for loading inert gas, in which the lateral folds of the upper face are folded inwards under the front and rear flaps, and the lateral folds of the lower face are folded outward and folded and stuck on the lower face over the front and rear flaps, and a method for forming the package.

18 Claims, 16 Drawing Sheets

(51) Int. Cl.
*B65D 81/20* (2006.01)
*B65B 31/04* (2006.01)

(56) References Cited

U.S. PATENT DOCUMENTS

| | | | | |
|---|---|---|---|---|
| 5,012,959 | A * | 5/1991 | Gordon | B65D 5/746 220/269 |
| 5,791,528 | A * | 8/1998 | Robbins, III | B65D 5/744 222/364 |
| 8,794,503 | B2 | 8/2014 | Burgos Agudo | |
| 9,656,776 | B2 * | 5/2017 | Sloat | B65D 5/2019 |
| 2010/0078467 | A1 | 4/2010 | Mortimore et al. | |

* cited by examiner

PROCEDURE FOR MANUFACTURING A LAMINATED PACKAGE FOR SOLID PRODUCTS IN POWDER OR GRAIN FORM, AS WELL AS A PACKAGE OBTAINED BY THIS PROCEDURE

BACKGROUND OF THE INVENTION

This invention refers to a package for solid products in grain or powder form, normally food products, chemicals, and animal food. The package is provided with a number of notches which make the cardboard stiffer on the different faces of the package, preventing its deformation when this is grasped in the hand. The invention also refers to a forming, filling and closing procedure for said package, which preferably uses a hermetically-closing injected plastic dispensing lid.

STATE OF THE ART

Some packages for general use consist of a paperboard box which houses a bag inside containing the packed product; this requires two different operations and manufacturing lines; one involves the product being packed in a polyethylene bag which is then closed in an inert atmosphere and in the other the package is formed, by bringing the full bags up to this to be inserted inside it. This type of packages involves different disadvantages. Manufacturing requirements mean that the bags require a large volume to insert the inert gas in relation with the volume of product contained. The size of the box is furthermore larger than necessary and gives rise to an excessive consumption of both the cardboard with which the cases are made and the polyethylene used for making the bags. The larger size does not only affect the consumption of material, but also the space requirements. As the packages are larger more storage and transport space is required.

What is more, reclosing the package after opening this represents a problem for the user, using means as rudimentary as they are unsatisfactory for this purpose, such as clothes pegs.

Lastly, and no less important than the above, is the use of bags added to the packages, which causes excessive waste and the ensuing pollution, which is a serious problem worldwide and is totally avoidable.

In the field of packing solid food there are also laminated packages made with at least a layer of paperboard and outer layers of plastic material, enabling filling products in an inert atmosphere with no presence of oxygen, such as those known as Gable Top. One problem in making this type of packages is that the chambers for filling with inert atmosphere are open, and require a large consumption of inert gas, normally nitrogen. The air space which has to be left at the top furthermore requires a larger-size package than necessary. Their opening is furthermore complicated and after this it is not possible to keep the hermetic seal without means external to this.

Before closing the package, it is common to modify the interior atmosphere in the manufacturing stage, reducing the oxygen concentration over the food that this contains. Known packages for solids do not include means for modifying the atmosphere after the package has been loaded with solid food and closed. Loading the solid food, which is done from the top in this type of packages, has to be done quickly to prevent any excessive consumption of inert gas.

In general, packages containing solid products in grain or powder form have a substantially prismatic shape with a rectangular section, with two narrow sides and two wide sides. Since the material normally used to make the packages containing these products is fairly thin, the packages tend to deform when they are gripped with one hand from one of the smaller vertical walls, and especially those of larger size and when they are full, since their weight requires greater pressure for holding these. It is thus desirable, and one purpose of this invention, to provide a package increasing its stiffness and resistance to deformation (shape recovery) without increasing the thickness nor the amount of the material used, which works out in better ergonomics for the user.

The packages known as Gable Top type without any inner bag have a prismatic shape, in which the top has a fold like a roof. This accentuates the volume problems mentioned above.

US 2010/0078467 A1 describes a package containing cereals which comprises an opening zone by means of breaking the package along a transversal strip. It does not have sealed reclosing means, nor any opening dispensing mouth.

U.S. Pat. No. 4,314,642 described a cardboard container which could be closed at its top by folding a flap. It does not have a dispensing mouth and the closure does not ensure watertightness.

EP 2474479 A1 discloses a paperboard container package formed from one laminated cardboard sheet and a number of folds at the top and bottom, in which the top part is provided with a threaded closure; it does not prove satisfactory for solid products, in powder or grain form because the mouth cannot guide the product properly in its dispensing action, nor has deformations in its rear and lateral walls increasing the stiffness of the package.

U.S. Pat. No. 8,794,503 describes a dispensing lid which is formed of a frame and a moving body hinged together, in which the frame is fitted as part of a package and the moving body, in its rotation movement, goes through a window existing in the frame and can be closed in a substantially hermetic way.

We do not know of packages with the characteristics described in this invention.

SUMMARY OF THE INVENTION

This invention consists of a laminated-type package, of the sort that contain solid products in powder or grain form which enable sterile sealing during the manufacturing stage and which is made up of the following elements:

- A substantially prismatic body with a rectangular section, made of a laminated paperboard provided with a backing of a plastic sheet material on its outer and/or inner side;
- A dispensing mouth placed at the top of one of the smaller lateral sides of the package, particularly consisting of a injected plastic lid, opening and able to close in watertight manner.
- A set of notches made in the material in the smaller face opposite to the one with the mouth;
- A set of linear notches made in the front and rear walls;
- At least one valve and preferably two valves through which an inert gas such as nitrogen can be inserted, and the air found inside the package can be extracted;

According to the invention, the prismatic body is provided with a window in which the dispensing mouth is ultrasonically welded. Said dispensing mouth specifically consists of a single injected plastic element which includes a frame which is fitted and welded to the plastified surface around the window in the package and a moving body which is hinged to said frame at its bottom, and which is totally or partly inserted in the window of the frame in the open or closed positions respectively forming an opening closure. The window in which the frame of the lid is placed has a shape substantially identical to that of the window forming the frame (or in the version with a counter-frame, slightly larger) and will have cutaways at its top corners in concordance with tabs placed in said frame.

The front and rear faces of the package are provided with notches. According to a specific, not limiting, embodiment, the main notches in the front and rear faces have an "X" shape. Specifically, one of these is continuous between two opposite corners and the other is a broken one, without crossing the front one, between the other two opposite corners.

Said main notches divide the front and rear faces into four triangular zones, two lateral ones, one upper one and one lower one.

In at least one of the triangular zones furthest from the dispensing mouth there is a set of secondary notches, which increase the rigidity of the front and rear faces of the package. Said secondary notches are placed in parallel to the vertical edges of the package, and are of lesser length the further towards the centre of the corresponding face these are placed.

As for the front and rear faces, the lateral face, opposite that of the dispensing mouth, which is the one that will normally be held by the user, is also provided with a set of third notches. Said third notches are formed from deformations of the material with a channeled shape and also have the effect of increasing stiffness and improving the aesthetics.

In a specific sense, the third notches are rectilinear and are set obliquely and in parallel in said side face.

In spite of this, within the scope of the invention, other options in which the notches have a totally or partly curved shape and have an irregular shape are also described. The arrangement of the notches can also be different to the one stated, also irregular.

After being made, the package has a prismatic shape, with the upper and lower faces flat and parallel to each other.

The package is made from a coil of material, either printed or laminated. The register or template is made by die-stamping or punching for making said package by folding and welding. The die-stamping operation will also form the windows that the package has to have, to place both the valves for loading/unloading the gas and the dispensing mouth in these. The forming operation also includes a series of notches or deformations in the surface of the package. These deformations have the purpose of making the body of the package stiffer.

A plunger is used to form the tubular body, joining and ultrasonically welding the flap of one of the lateral (vertical) edges with the end of the opposite one. The plunger has a shape so as to allow the notches to be housed, maintaining the support against the respective surfaces. After forming the tubular body the upper face is made. To this end the register has (horizontal) folding notches which define the upper perimeter and in continuity with the vertical edges, folding notches of said upper face. Furthermore, between the extension of each pair of edges corresponding to the lateral faces (smaller faces) oblique folding notches are placed, forming triangular portions with a vertex at the outer (upper) edge of the register. The upper face is formed by pushing the triangular portions inwards and at the same time the ones for the front and rear faces, which mount over each other and rest on the plunger and are also welded ultrasonically. The front and rear portions have a width greater than half the width of the top face and normally one of these portions (the one that will be left facing towards the upper face) will have cutaways in the lateral corners to allow proper overlapping with the fold of the triangular portions, and the other will mount over the previous one and have a straight or curved edge which will go beyond the mid-line of said upper face.

After forming the upper face the frame of the dispensing mouth will be placed over the window made for this purpose in the body of the package. The join will be made ultrasonically. To this end the frame has a set or ribs to facilitate the welding.

According to another embodiment the frame will be placed in the window prior to forming the upper face. In this embodiment the lid can be fitted by means of a counter frame which is placed inside the package, to proceed to weld this ultrasonically to a portion of the frame which goes through the window and to the interior surface of the package, and later on said face will be made as already described.

The plunger is partially withdrawn and the dispensing lid is closed, inserting the moving body into the window of the frame, until this is completely closed. Valves for introducing and extracting gases are also fitted, inserted in windows made for this purpose, for example at the top of the opposite side to the one in which the dispensing lid is placed.

With the dispensing lid closed a seal is placed over said lid, to block any communication between the exterior and the interior of the package through the joints of said cover.

After doing this the package is turned over, so that the lower face of the package is upward (open part) and the upper part (closed) below. In these conditions the package is in position to receive the product contained in this.

The product is thus inserted into the package. After filling the container the lower part (placed upward) is closed. The lower part has a shape similar to the upper part, but prolonged along the perimeter in a flap. To seal the package, the extensions of the front and rear faces are folded, leaving the triangular portions facing outward, so that the flap emerges from the face formed and is thus held between two securing elements and ultrasonically welded. The welding along the whole length of the flap guarantees total sealing of the package. The flap is later folded over the lower edge and the triangular portions are also folded over the lower face and stuck to this.

In these conditions two nozzles are placed over the valves (this can be a dual action one). Through these nozzles the inert gas such as nitrogen is inserted and also the air contained in the package is extracted, radically reducing the oxygen present in said package and improving the keeping of the product contained in this for a long period of time.

According to another embodiment, the package is formed directly with the bottom face facing upwards, a position in which the upper face is folded and sealed (the upper face is located downward in this operation), the open dispensing mouth is fitted, the mouth is folded and the seal is fitted, the valves are fitted and the filling and folding of the lower face are carried out, this being upward, as described above, omitting the first turnover operation, now proceeding to turn this over to load the gas and extract the air.

BRIEF DESCRIPTION OF THE DRAWINGS

In order to illustrate the following explanation we are enclosing 16 sheets of drawings with this descriptive report, in which seventeen figures represent the essence of this invention, as an example without constituting any limitation thereto, and in which.

Figure 1:
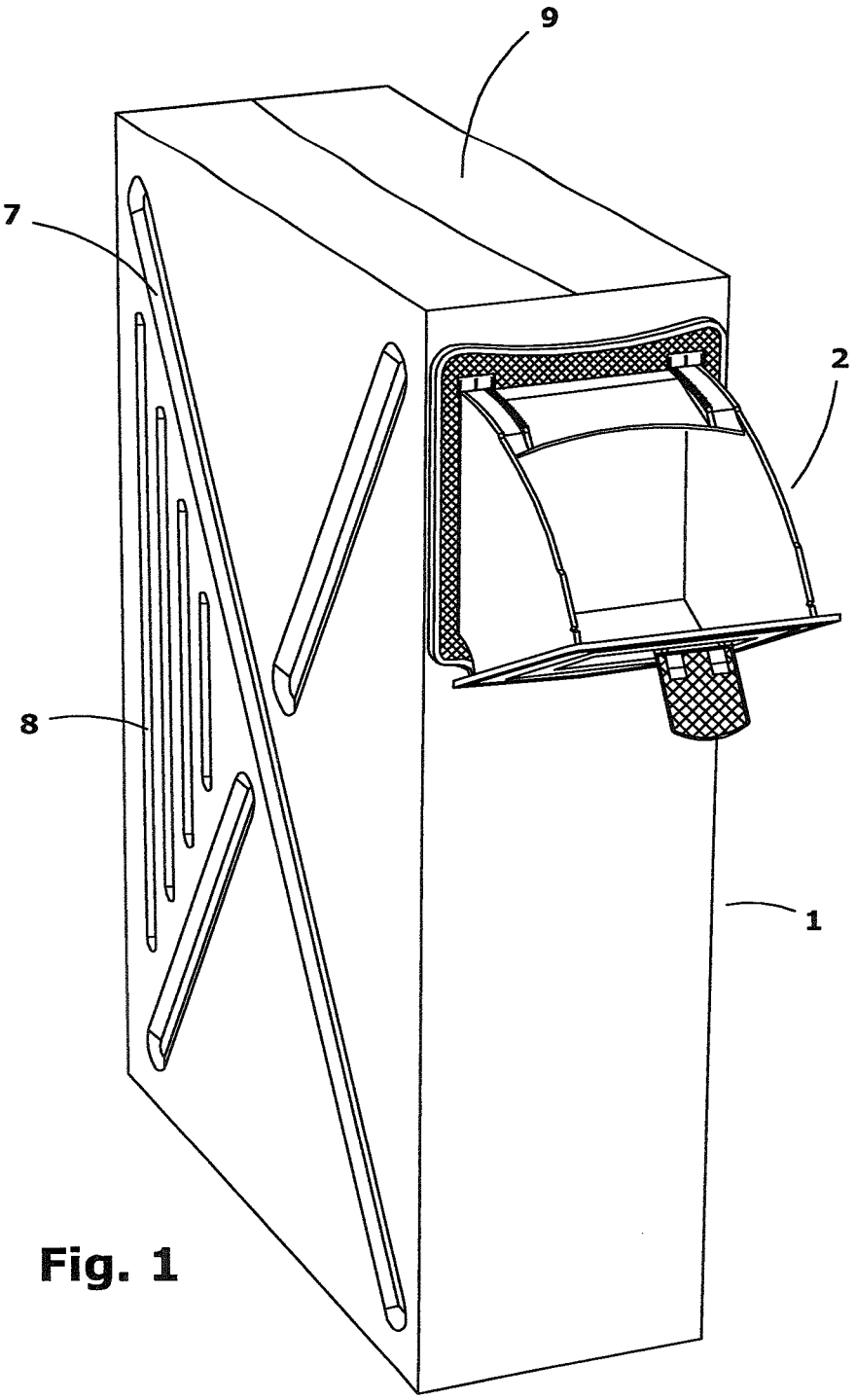
FIG. 1 shows a view of the package of the invention, with the dispensing mouth open, in usage condition.
Figure 2:
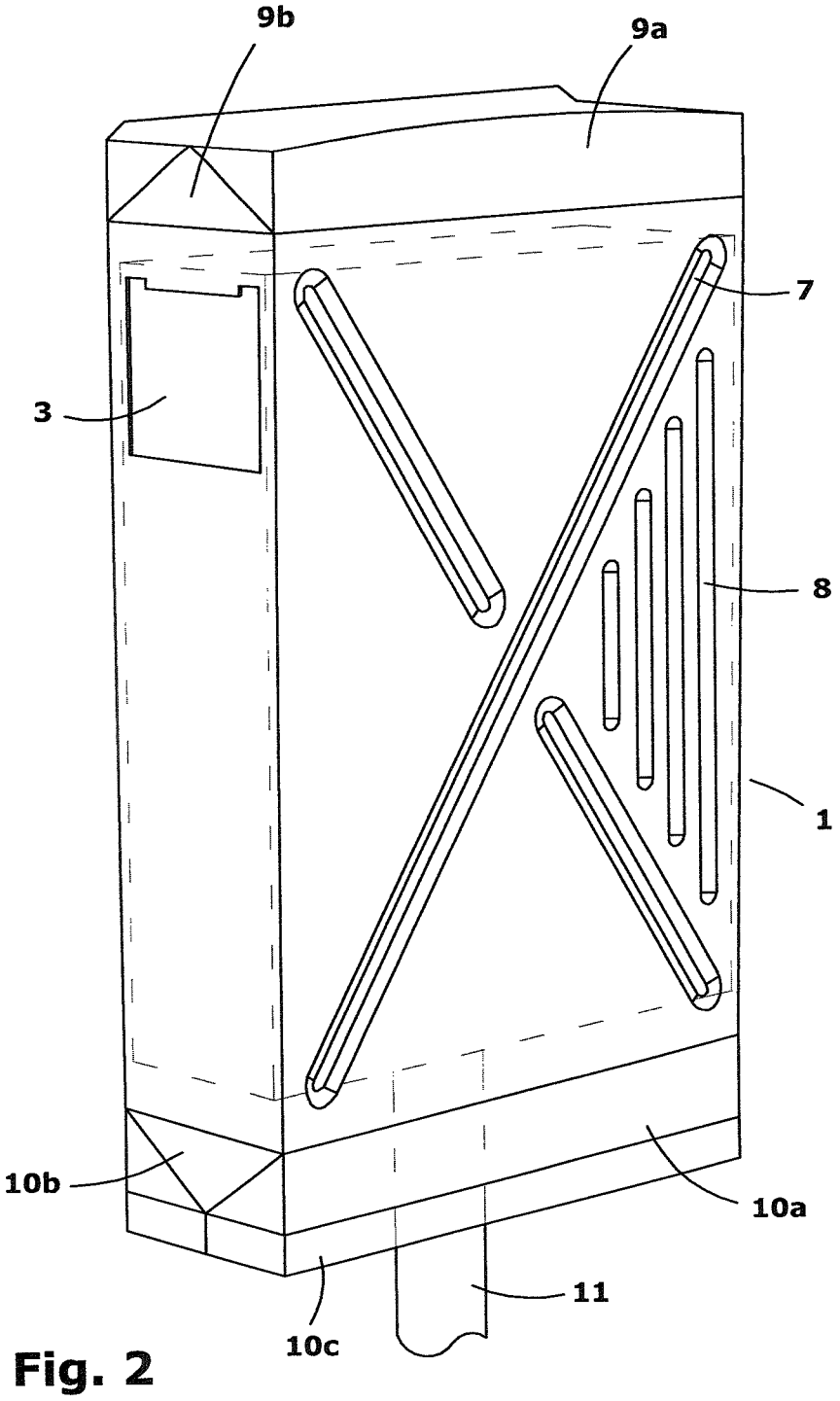
FIG. 2 shows a view of a first phase of manufacturing the package with a plunger inserted inside this, and with the upper and lower faces not yet folded.
Figure 3:
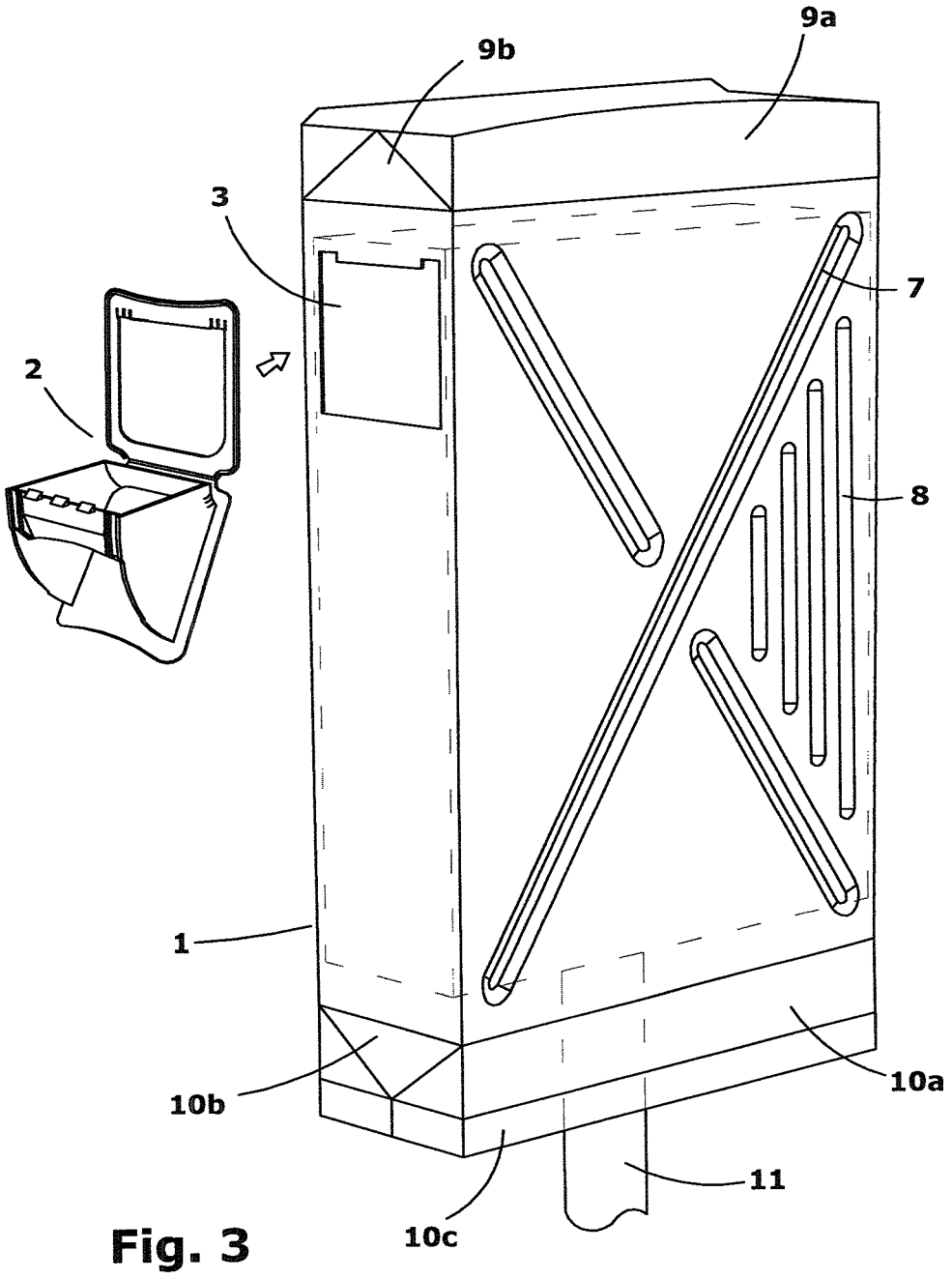
FIG. 3 shows a view of the package in a second phase of manufacturing the package, with the plunger still inside this, in which a dispensing mouth is fitted.
Figure 4:
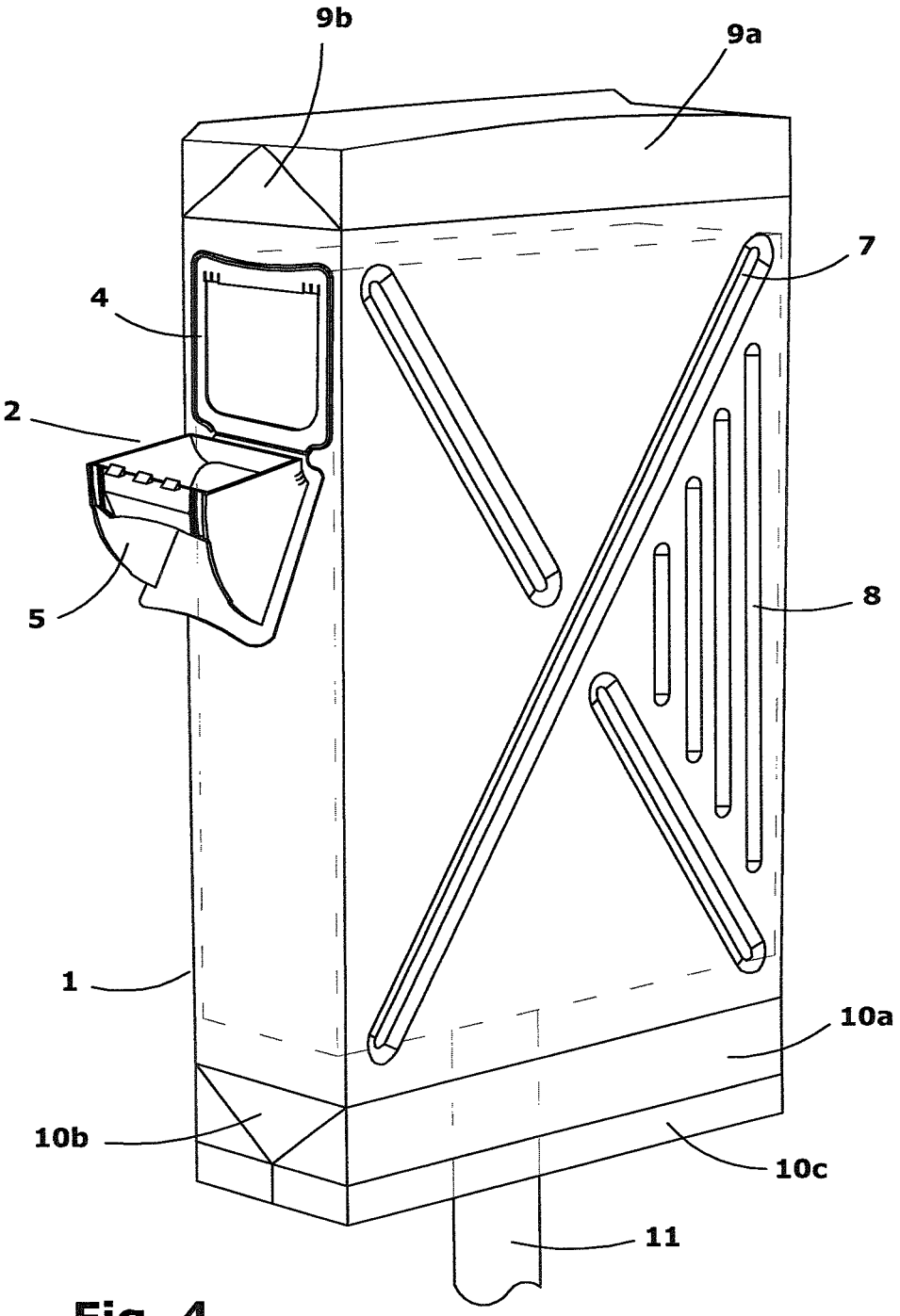
FIG. 4 shows a view of the package in the manufacturing stage of FIG. 3, with the frame of the dispensing mouth already fitted in the package.
Figure 5:
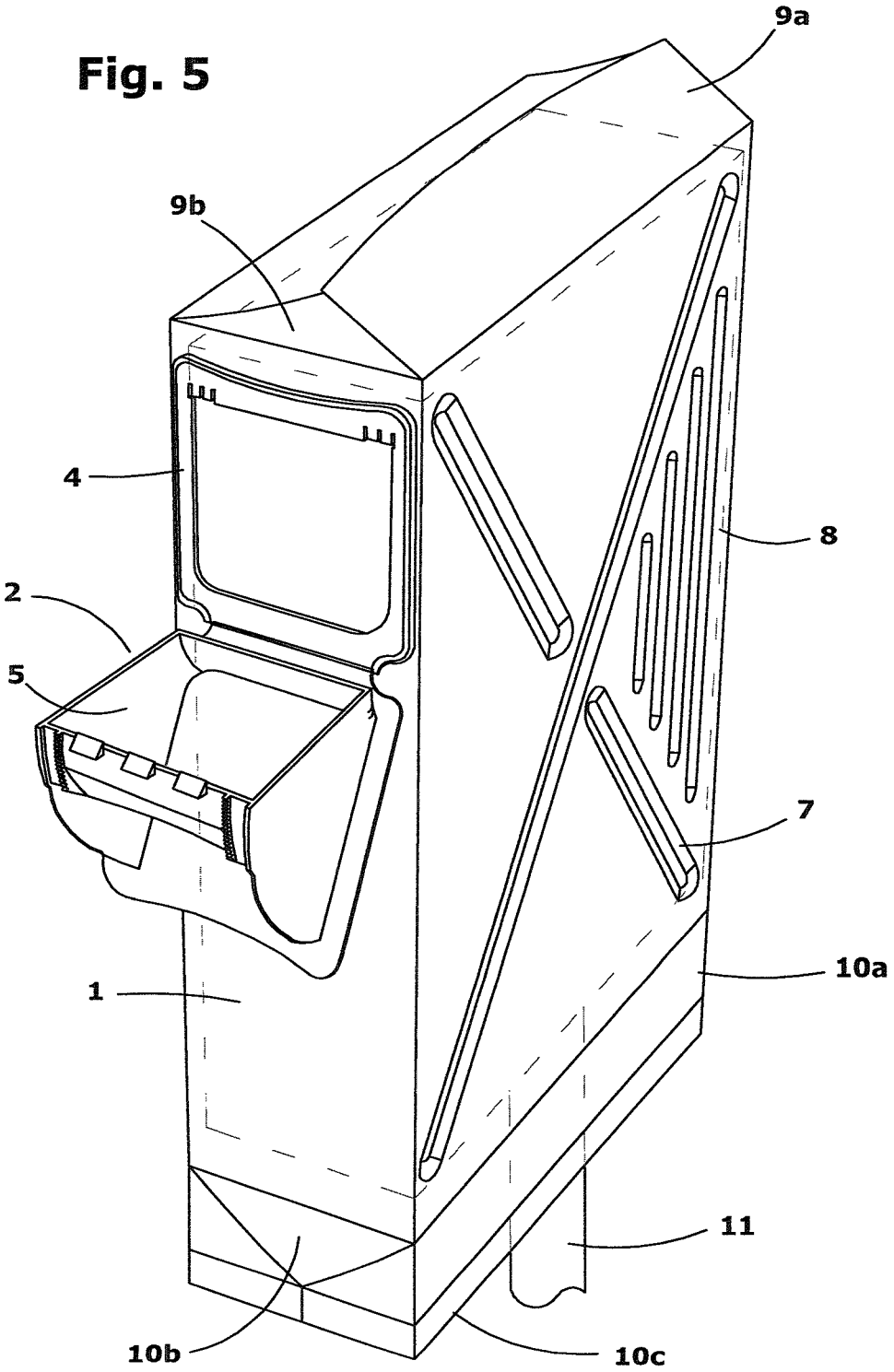
FIG. 5 shows a view of the package in a third manufacturing stage, in which the upper face is being folded.
Figure 6:
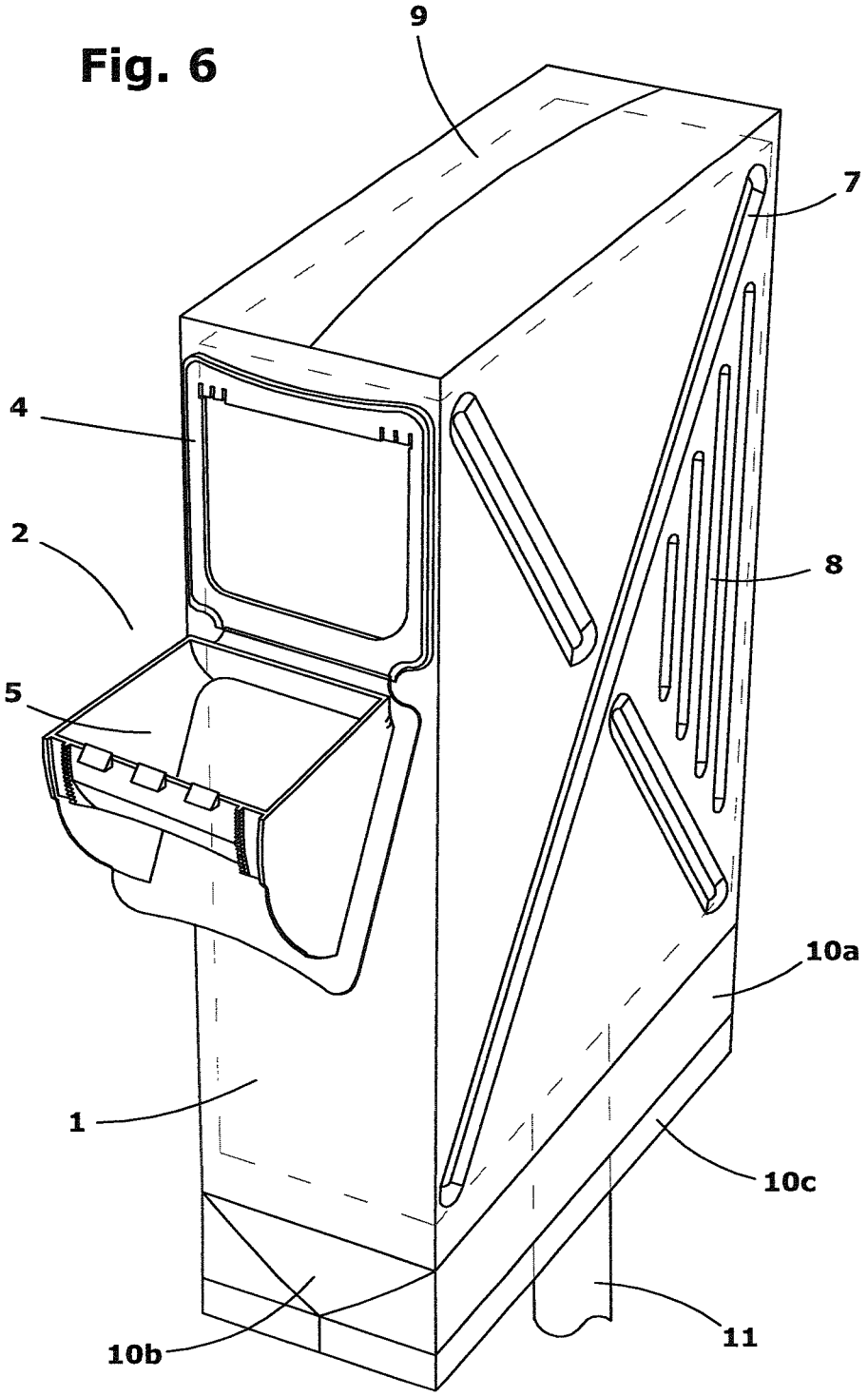
FIG. 6 shows a view of the package in a fourth manufacturing stage, in which the moving body of the dispensing mouth is positioned out of the frame of said mouth, by turning this in respect of the hinge that joins them.
Figure 7:
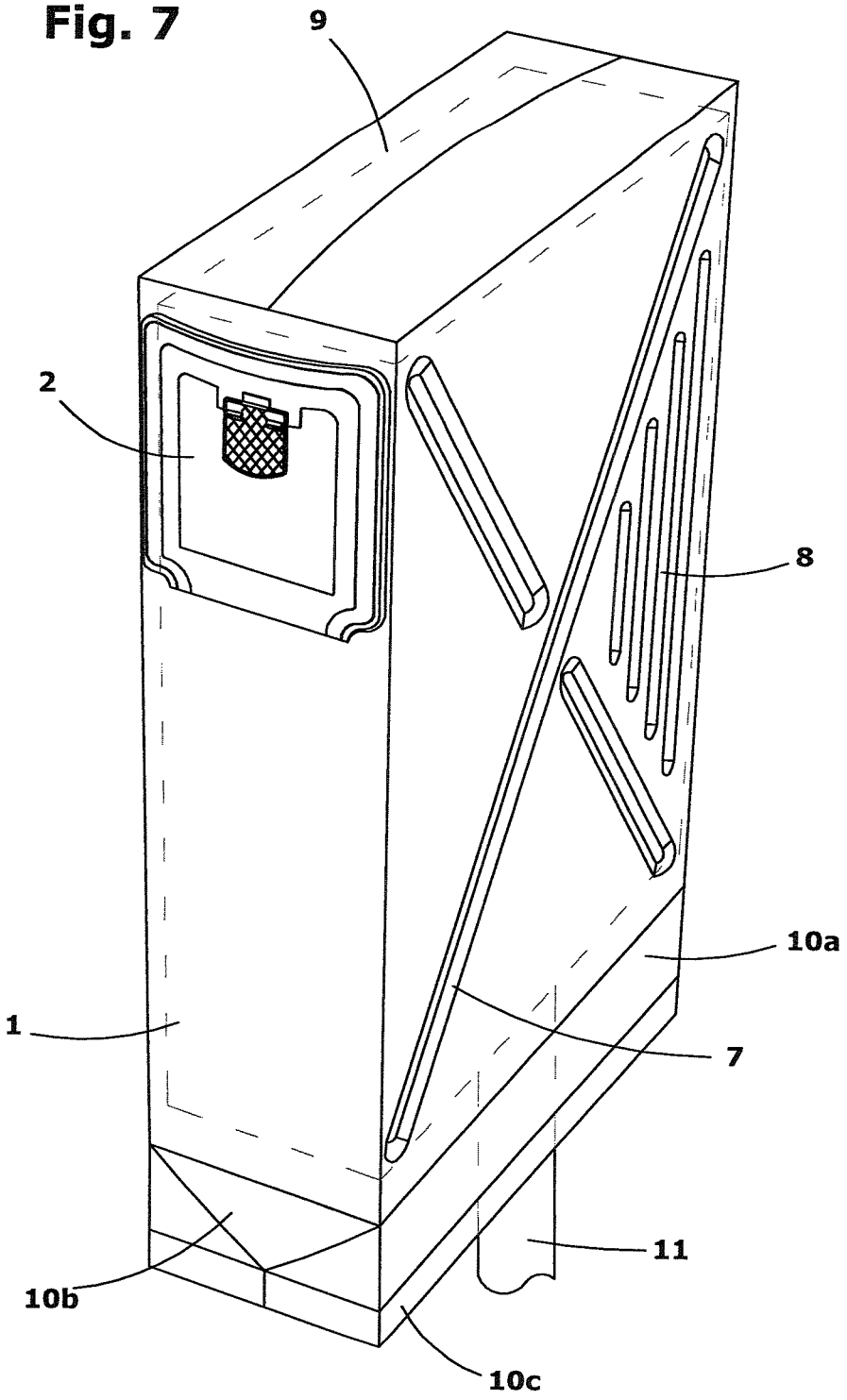
FIG. 7 shows a view of the package with the previous operation completed, with the upper face completely folded and the dispensing mouth completely closed, but with the lower face still not folded.
Figure 8:
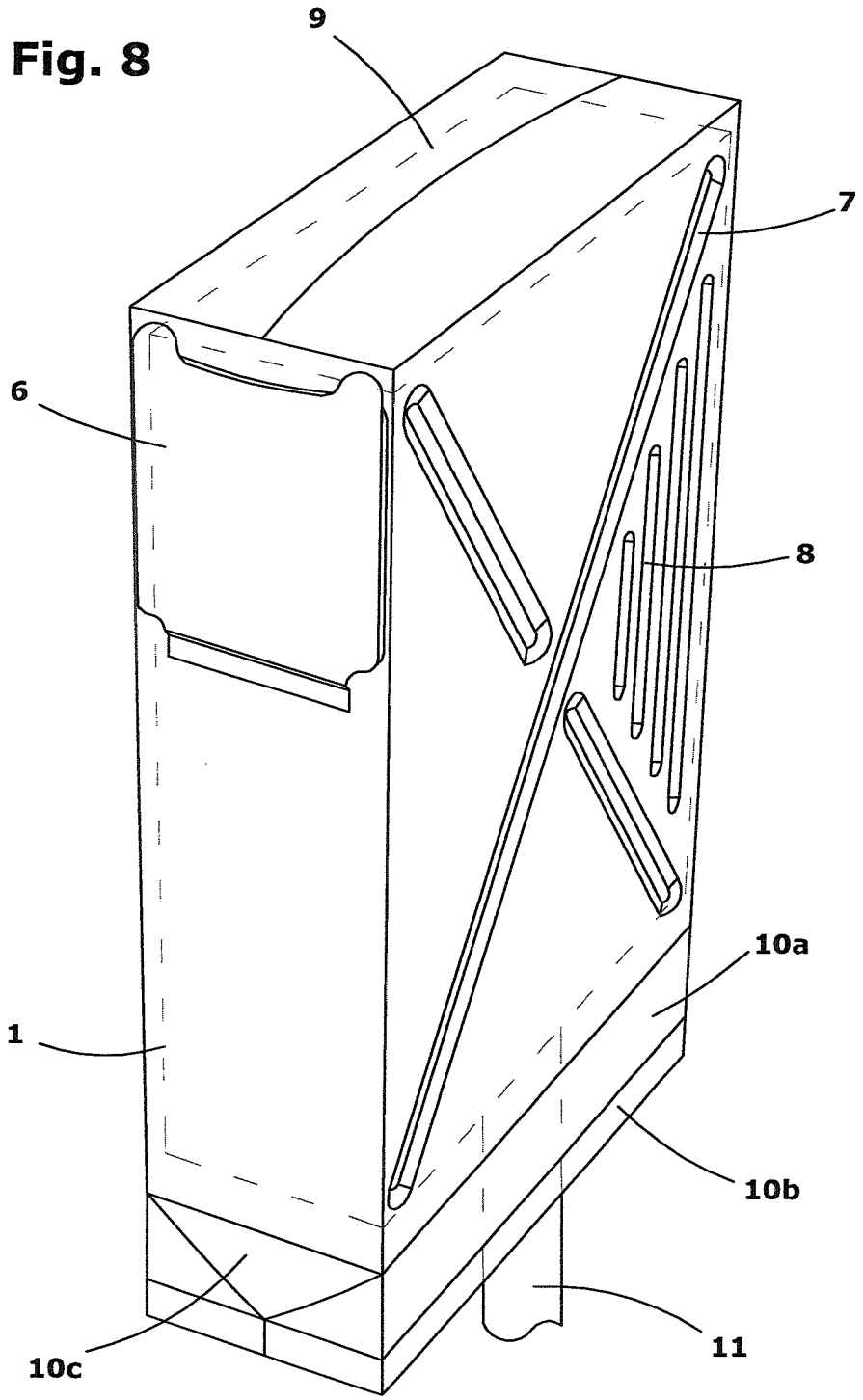
FIG. 8 shows a view of the package in a fifth manufacturing stage in which a seal is placed over the dispensing mouth.
Figure 9:
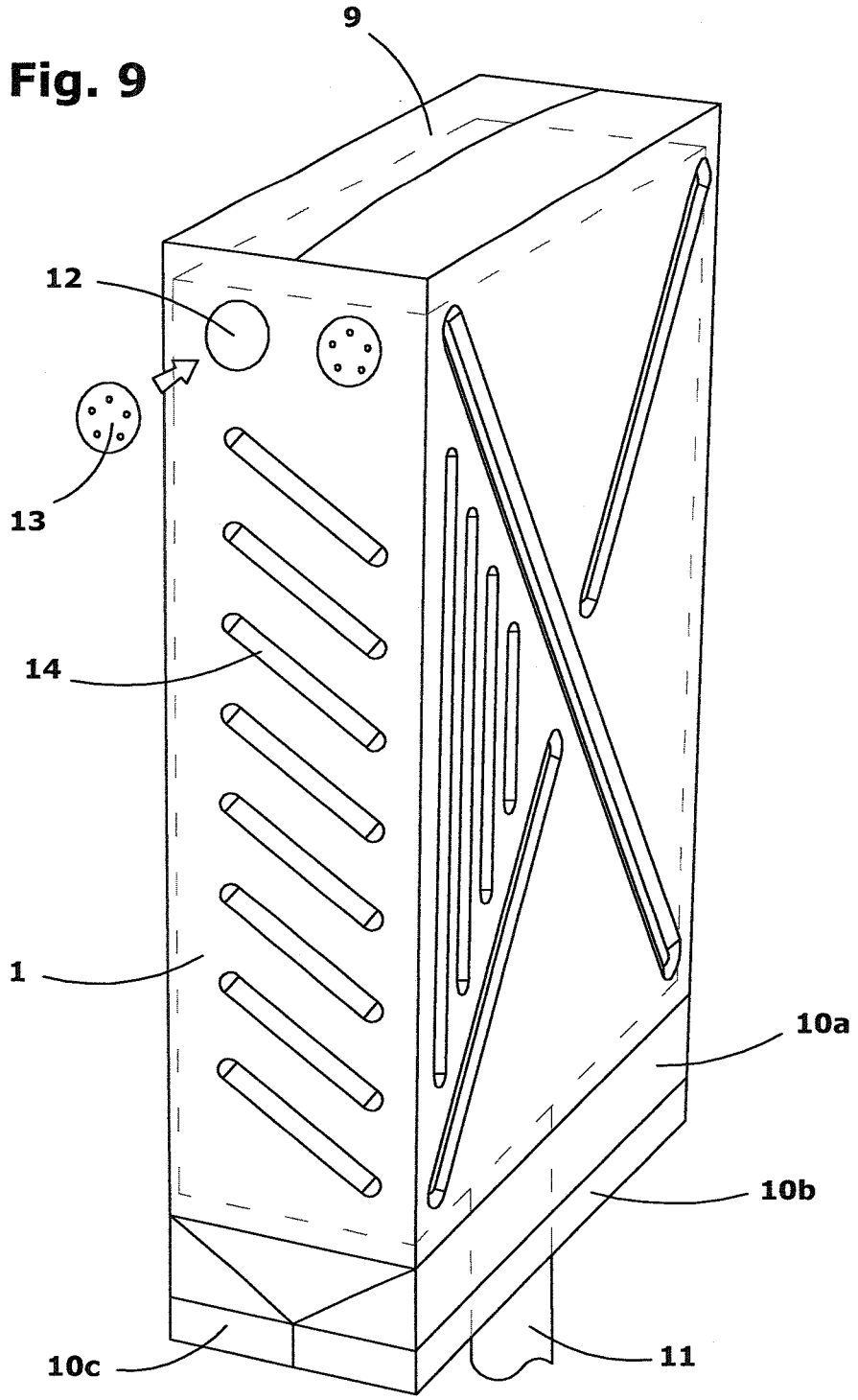
FIG. 9 shows a view of the package from an angle opposite to that of the dispensing mouth, in an operation in which the gas valves are being fitted; this operation can be carried out simultaneously with the phase of fitting the dispensing mouth or in a separate phase.
Figure 10:
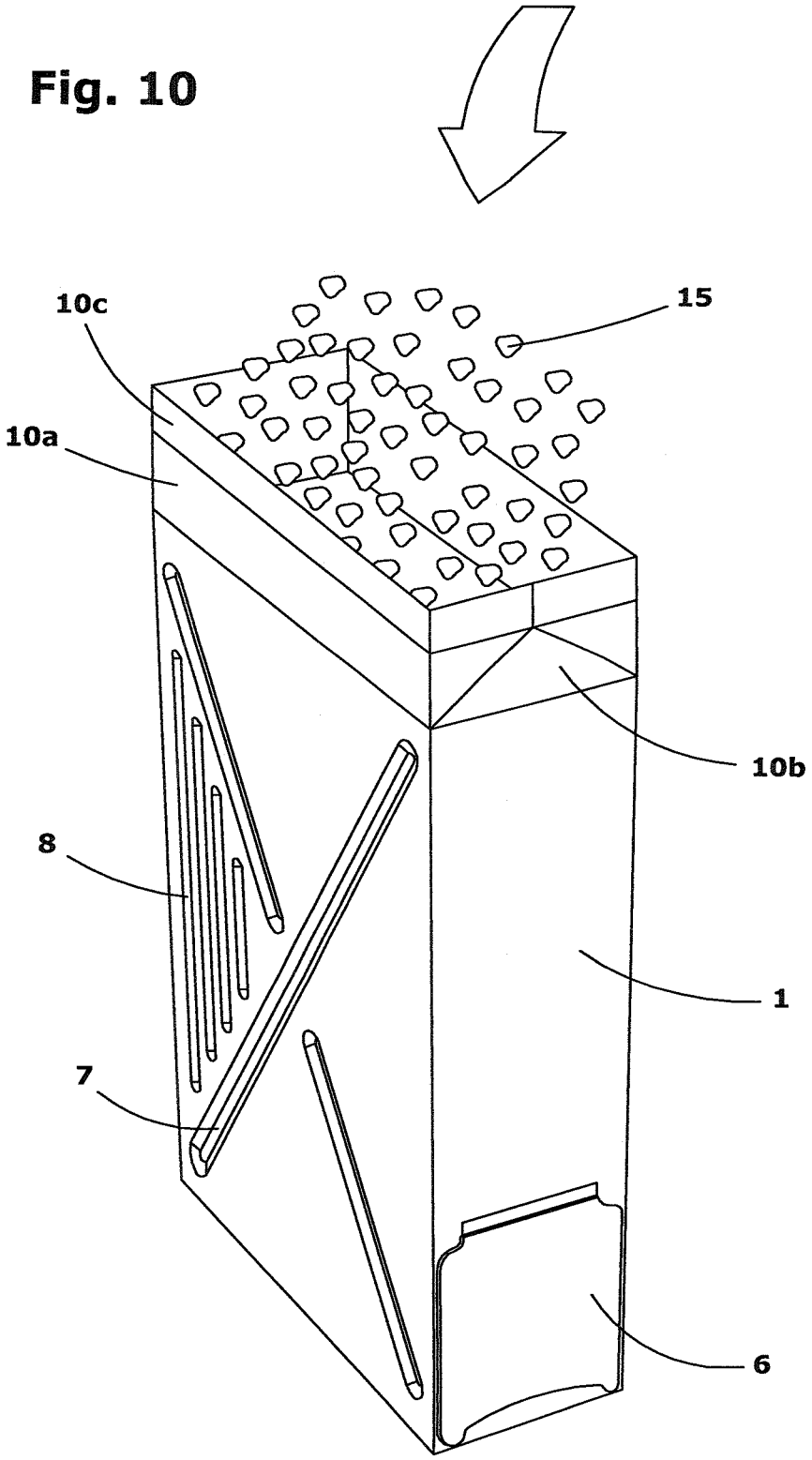
FIG. 10 shows a view of the package in a sixth stage of the operation in which the package has been turned over, placing the lower face upward, and filling the package with the required product.
Figure 11:
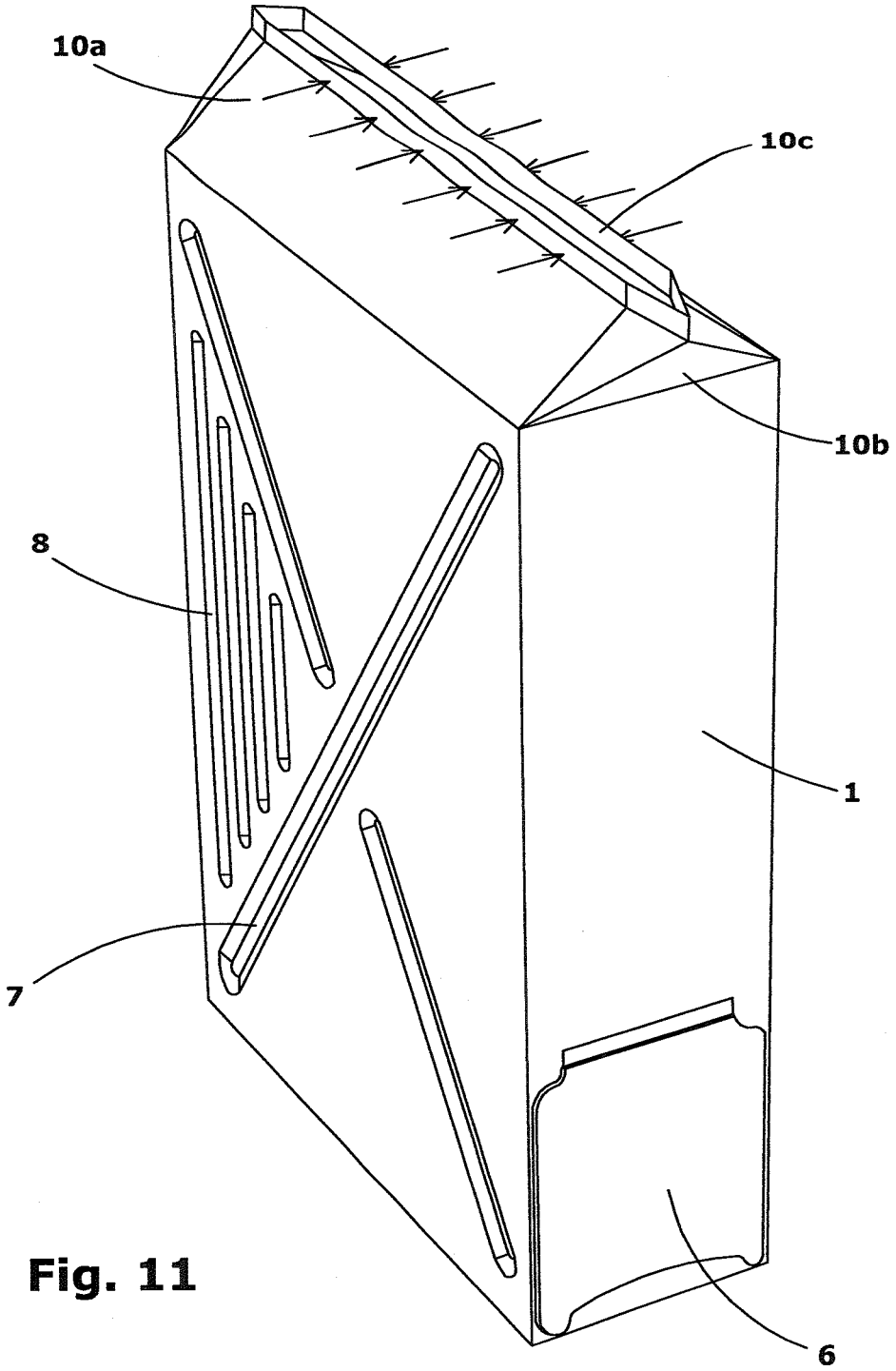
FIGS. 11 and 12 show a view of the package in a seventh stage of the operation, in which a sealing flap of the lower face is respectively welded and folded.
Figure 12:
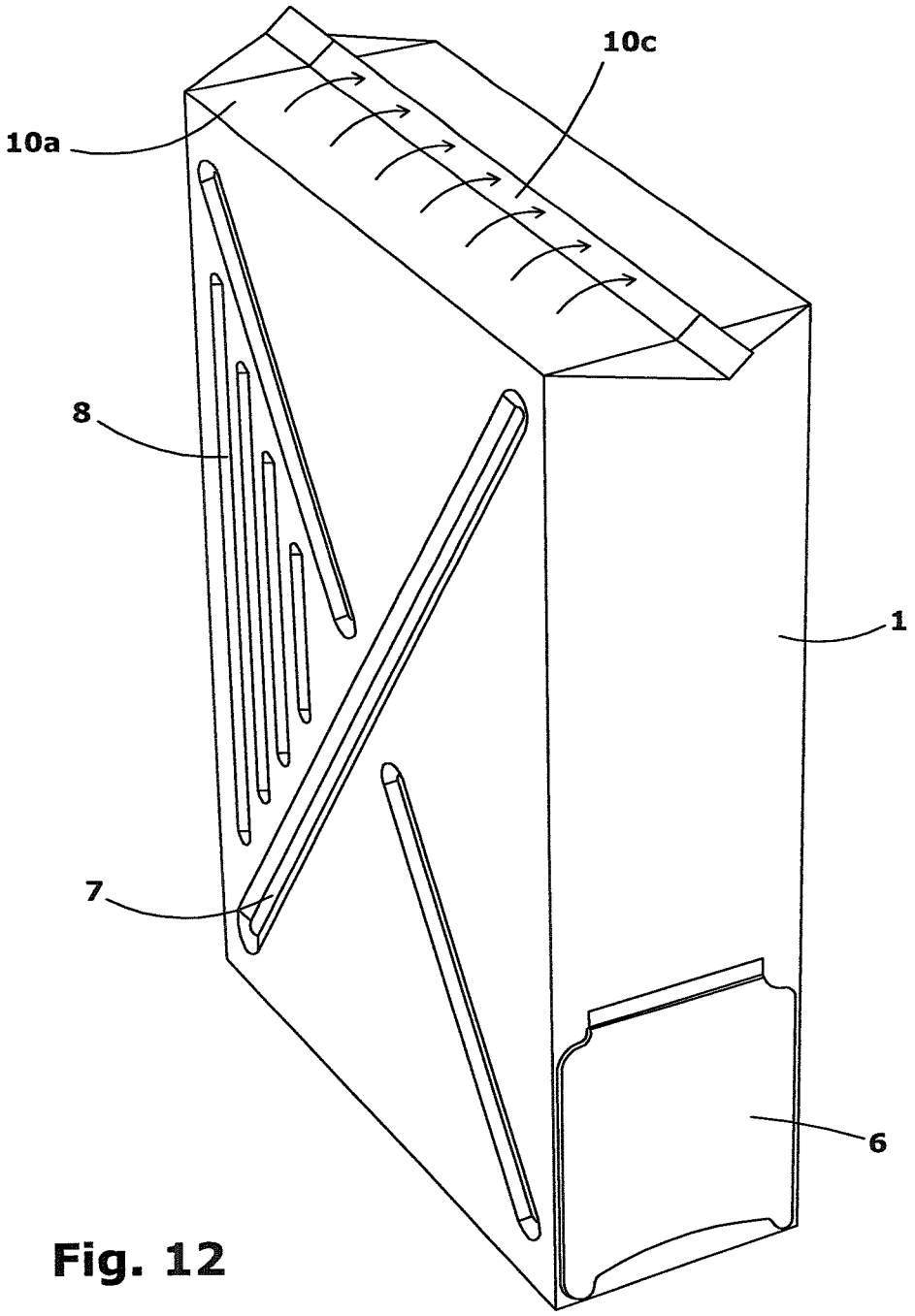
Figure 13:
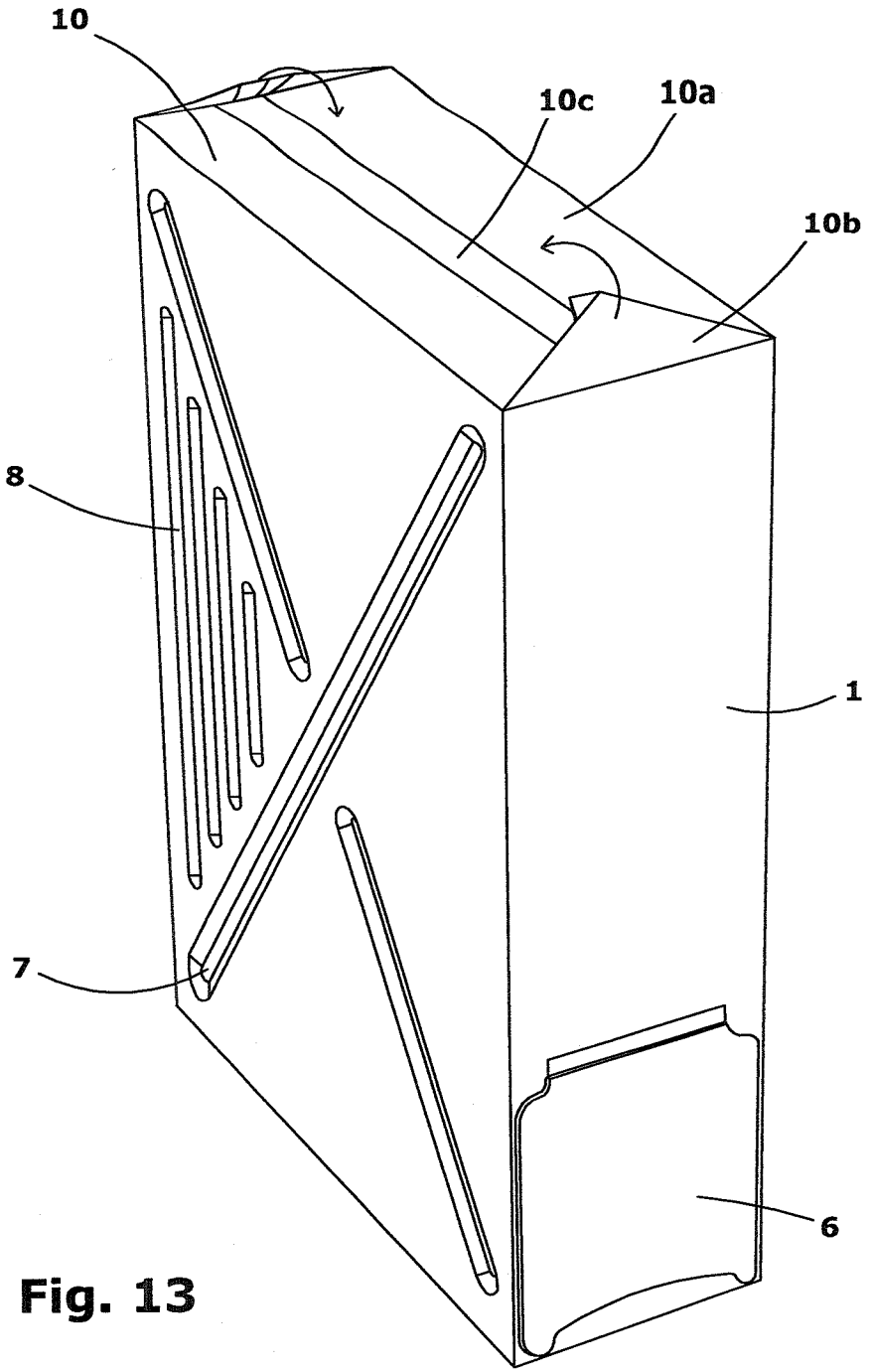
FIGS. 13 and 14 show different views of the package in an eighth phase of the operation in which the sealing flap is folded over the lower face and the triangular portions projecting over said lower face are folded, after which the package is turned over again so that the lower face is facing downward and the upper one upward.
Figure 14:
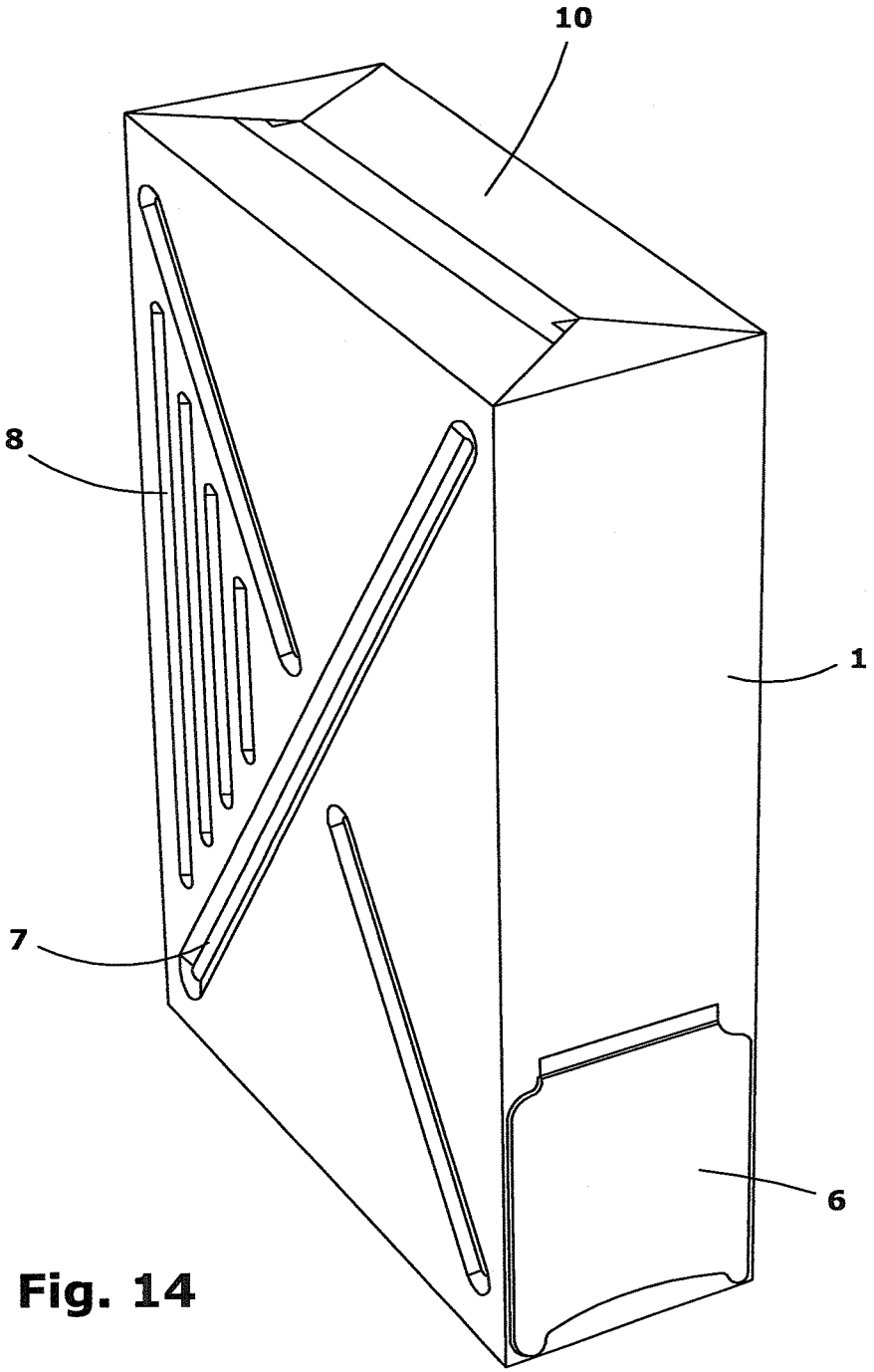
Figure 15:
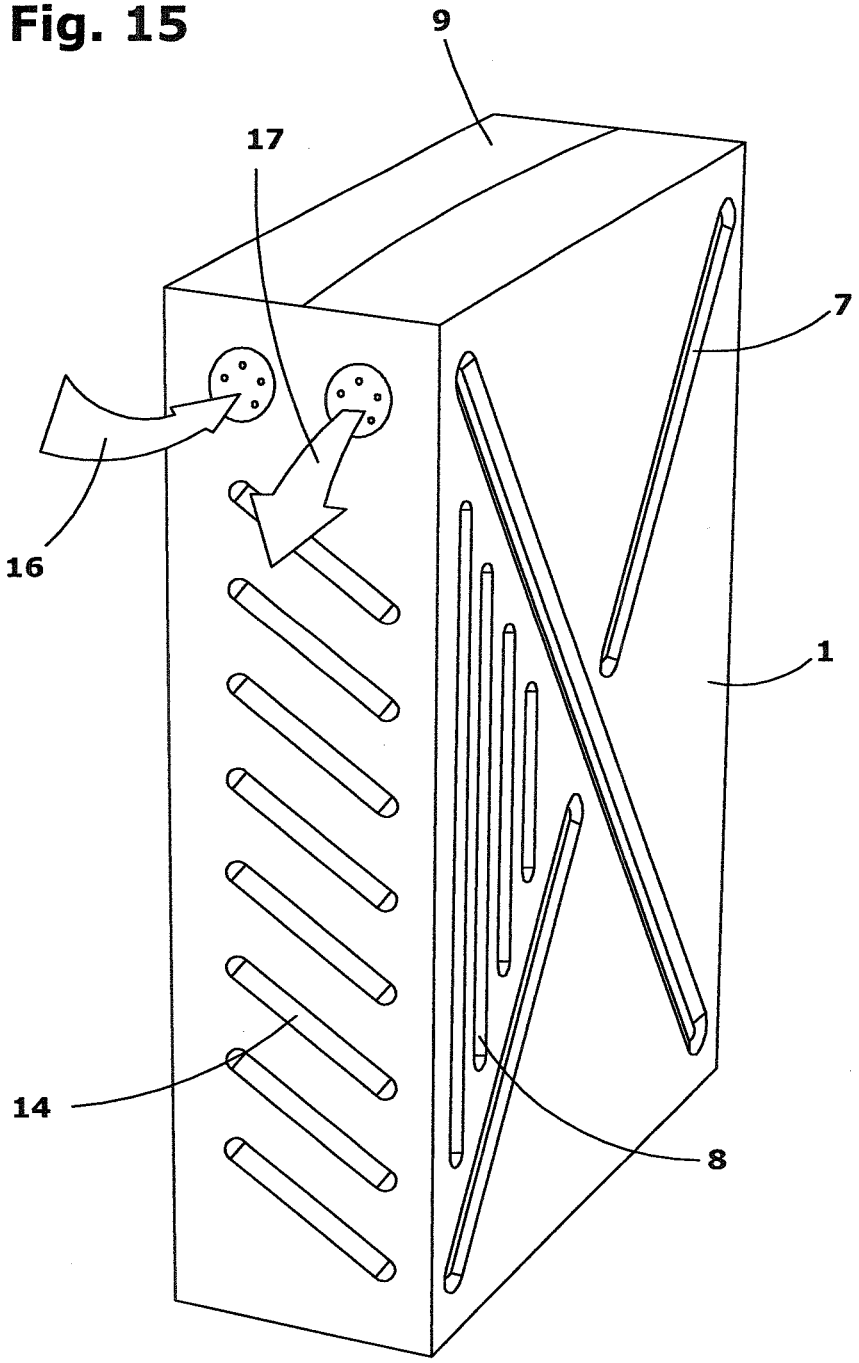
FIG. 15 shows a view of the package in a ninth stage of the operation, in which inert gas is inserted and the air inside the package is extracted through the gas valves.
Figure 16:
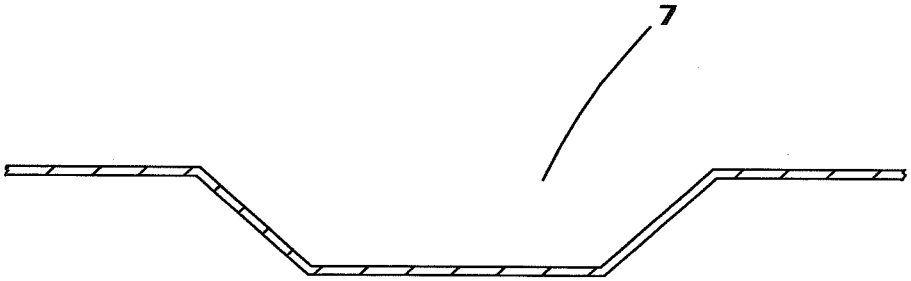
FIG. 16 shows a schematic cross-section view of an embodiment of the main notches.
Figure 17:
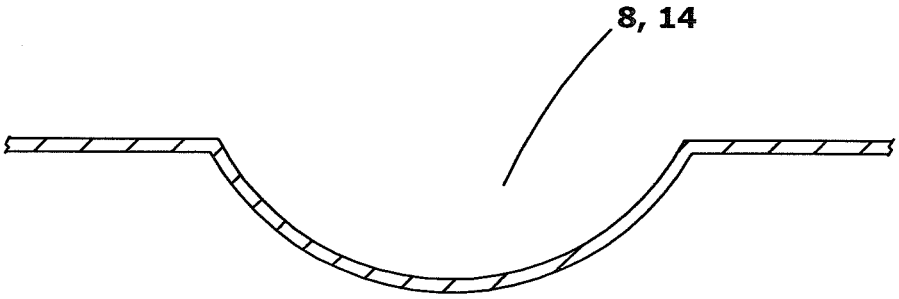
FIG. 17 shows a schematic cross-section view of an embodiment of the secondary notches and third notches.

The following reference numbers are used in these figures:

1 package
2 dispensing lid
3 window made in the package for the dispensing lid
4 frame of the dispensing lid
5 moving body of the dispensing lid
6 seal of the dispensing lid
7 main notches
8 secondary notches
9 upper face of the package
9*a* front and rear upper flaps of the package
9*b* lateral upper flaps of the package
10 lower face of the package
10*a* front and rear lower flaps of the package
10*b* lateral lower flaps of the package
10*c* lower flaps for sealing
11 plunger or piston placed inside the package in the forming stage
12 windows for the insertion of valves for loading gas and extraction of the air contained in the package
13 valves
14 third notches
15 packaged product
16 inert gas injected in the package
17 air with oxygen extracted from the package

DETAILED DESCRIPTION OF THE EMBODIMENTS OF THE INVENTION

A laminated package (1) is described, intended for solid products (15) in powder or grain form, which is made from a coil of a laminated material. This material is made up of a paperboard sheet with at least one layer of outer coating and at least one layer of inner coating made of a plastic material. There could be additional layers, although said lamination is not the subject of this invention. Although polyethylene is normally used for coatings due to its low price and appropriate isolation capacity, it has been found that polypropylene furthermore has better characteristics for welding different items on this, particularly by ultrasonic means, such as a dispensing mouth (2) of injected plastic (normally polypropylene), or valves (13) for loading inert gas (16) or extraction of air (17) with oxygen. Other plastics could nevertheless be used for the outer layers, these plastics being able to be different for the inner layer and for the outer layer.

The package (1) is provided with an opening dispensing mouth (2) located on one of the lateral faces in a position close to the upper face (9). Lower face (10) is defined throughout this description as the supporting face of the package, in which the lower folds are located, and upper face (9) means the opposite face. The laminated material of which the package is made is previously printed.

The surface of the package is provided with a set of notches (7,8,14) for stiffening this. The notches (7,8) are located on the front and rear faces, as well as also (14) on the opposite face to the one which has the dispensing mouth (2).

Said notches are main notches (7) in the form of an "X" which are placed on the front and rear faces (larger faces). These main notches (7) divide each of said faces into four triangular zones. These triangular zones are an upper zone, a lower zone, a lateral zone close to the face provided with the dispensing mouth and a lateral zone farther from the face provided with the dispensing mouth. According to one embodiment of the invention, the triangular zone furthest from the dispensing mouth is provided with a set of second notches (8) which are placed in parallel to each other (vertically). Other triangular zones can also be provided with stiffening notches according to less preferred options.

Although it is designed for the main notches (7) and the second notches (8) to be straight, it is also possible, within the scope of the invention, for these to have a curved shape or any other irregular form.

According to a preferred option, the main notches (7) have a grooved section with divergent lateral walls, and the second notches (8) have a curved section.

According to a non-limiting option, the number of second notches (8) is four, decreasing to the centre of the "X" formed by the main notches.

The lateral face opposite to that of the dispensing mouth is also provided with third notches (14). According to a preferred, non-limiting option, said third notches (14) are arranged in parallel to each other and obliquely in respect of the edges of the package. Said third notches (14) could also be in another shape, such as a curved or irregular form, within the scope of the invention.

Also according to a preferred option, the third notches have a curved section.

According to a non-limiting option, the number of third notches is eight.

The upper face (9) of the package is formed of upper front flaps and upper rear flaps (9*a*) and lateral upper flaps (9*b*), folded in respect of the lateral faces and in themselves, forming a flat face in which the lateral folds are bent inwards under the front and rear flaps.

The lower face (10) of the package is formed of front lower and rear lower flaps (10*a*) and lateral lower flaps (10*b*), folded in respect of the lateral faces and in themselves, and in which the outer edge of said flaps has an over-extension (10*c*) for sealing. The lateral folds (10*b*) are folded outwards and later folded and stuck on said lower face (10) outside the front and rear flaps (10*a*).

It is designed for either the package or the dispensing lid to be provided with valves (13) for loading inert gas (16) and extracting the air (17) contained in the package. If the valves are placed in the package, it is designed for these to be placed beside the upper edge of the face opposite to the one with the dispensing lid (2). A single valve (13) can optionally perform both functions, with a dual action nozzle (injecting inert gas and extracting air). In the event of the valves being located in the dispensing mouth (2), this is totally and hermetically sealed over the surface of the package, in the window made for this purpose in the template or register from which said package is made.

The invention also refers to a procedure for making the package of claim 1.

Said procedure involves the following stages being carried out:

A set of notches is made through deformation of the surface from a coil of material (paperboard) previously printed and laminated, especially by means of outer and inner sheets of a plastic material such as polypropylene. Said notches normally include main notches (7) and second notches (8) corresponding to the front and rear faces and third notches (14), corresponding to the lateral face opposite to the one in which the dispensing mouth will be placed. Because the notches represent a deformation (a retraction) of the material, the printing must be done considering said retraction.

After the notches have been made, the next procedure is to make the folding marks, corresponding to the vertical edges, the horizontal edges, and the closing folds of the upper (9) and lower (10) faces of the package. Simultaneously or consecutively to the above a window (3) is die-pressed, in which the dispensing mouth will be placed, as well as the outer contour or the template or register from which the package will be made. The dispensing mouth (2) may be fitted with valves for loading inert gas and extracting air. According to another option, one or more windows (12) are also die-pressed for placing the valves for loading inert gas (16) and extracting the air (17) contained in the package.

The operations for forming the notches and die-stamping can also be performed in any order, always taking into account the contraction rate.

After making the template, this is fitted onto a plunger (11), folded at its vertical edges and welding, normally by ultrasonic means, the lateral ends to form a tubular body. The plunger is retractile to be able to perform the successive later operations.

With the tubular body formed, the frame (4) of the dispensing mouth is then fitted and welded in the window made for this purpose in the template. As has been stated, the dispensing mouth is provided with the frame (4) and with a moving body (5) joined to said frame by means of a hinge. In the case of windows having been made for the valves (12), the corresponding valves (13) for loading inert gas and extracting air will also be fitted.

After the dispensing mouth has been fitted and welded, the next steps carried out are the folding and joining by welding, normally by ultrasonic means, of the different flaps forming the upper face (9) of the package. The flap hinged to the front face is placed over the flap hinged to the rear face. The lateral folds are located on the inside, under the front and rear flaps.

The moving body is turned in respect of the hinge and then inserted in the window which forms the frame of the dispensing mouth until the dispensing mouth is completely closed.

With the dispensing mouth closed a seal (6) is fitted over said mouth, guaranteeing total watertightness of the package, after being closed. The seal can be fitted in this operation or in later operations.

The aforementioned operations can be done with the package in "normal" position with the upper face upward (the face that is closed to the dispensing mouth) and the lower face downward or in inverted position, with the upper face downward and the lower face up.

In the event of the package not being inverted, the package is turned over so that the package has its upper face, already formed, downward, and the lower face, still not formed, open, upward.

In this position the package is filled with the corresponding consumer product.

After the package has been filled with the required amount of product the lower face (now facing upward) is closed and sealed. To this end the over-extension of the flaps of the lower face is folded and welded, normally by ultrasonic means, the lateral folds being left outward. The flap folded over the lower face is folded and stuck, and then the lateral folds projecting over the surface of the lower face are stuck.

The full and closed package is turned over so that its upper face is upward and its lower face downward and with the valves for loading inert gas and extracting air located in the zone close to the upper face.

As the final operation, nozzles are fitted on the valves for loading inert gas and extracting air, whether these valves are placed in the package or in the dispensing mouth. Inert gas, normally nitrogen, is injected and the air contained in the package is simultaneously extracted.

In these conditions a long-lasting package prior to the first opening is obtained, this duration being prolonged in respect of packages with no closure due to the dispensing mouth which can be effectively closed; the package is also free of any additional materials such as bags, simplifying both the manufacture of the package and its packing and the recycling of said package after being used.

The invention claimed is:

1. A laminated package for solid products in powder or grain form, comprising a die-pressed coil of printed and laminated material which defines an outer shape of a template of the package, a window at a top of one side of the package, an opening injected-plastic dispensing mouth positioned in the window, a set of main stiffening notches set in front and rear faces of the package, at least one further window in said package, and at least one valve for loading inert gas and evacuating air contained in the package, positioned in the at least one further window.

2. A package according to claim 1, wherein the window includes upper corners provided with cutaways, and the dispensing mouth which is located in the window includes a frame positioned in the window and including tabs in concordance with said cutaways.

3. A package according to claim 1, wherein the main stiffening notches include first notches in an "X" shape, and defining upper, lower and lateral triangular zones.

4. A package according to claim 3, wherein the first notches each have a grooved section with divergent lateral walls.

5. A package according to claim 3, wherein the main stiffening notches include a set of parallel, vertically oriented secondary notches in one said lateral triangular zone opposite to a side of the package in which the dispensing mouth is fitted, extending from a corresponding vertical edge to a zone of intersection of the first notches, and wherein the secondary notches each have a curved section.

6. A package according to claim 1, further comprising additional notches in a lateral face of the package opposite to a lateral face in which the dispensing mouth is positioned, wherein the additional notches are parallel to each other.

7. A package according to claim 6, wherein the additional notches are placed in an oblique position.

8. A package according to claim 6, wherein the additional notches each have a curved section.

9. A package according to claim 1, wherein:

an upper face of the package is formed with a front upper flap, a rear upper flap and lateral upper flaps, folded in respect of lateral faces of the package and of each other, forming a flat face, in which lateral folds are bent inwards under the front and rear upper flaps; and a lower face of the package is made up of a front lower flap, a rear lower flap and lateral lower flaps, folded in respect of lateral faces of the package and of each other and outer edges of said flaps have a sealing over-extension, such that the lateral lower flaps are folded outward and folded and stuck on said lower face outside the front and rear lower flaps.

10. A laminated package for solid products in powder or grain form, comprising a die-pressed coil of printed and laminated material which defines an outer shape of a template of the package, a window at a top of one side of the package, an opening infected-plastic dispensing mouth positioned in the window, and a set of main stiffening notches set in front and rear faces of the package, wherein the dispensing mouth comprises at least one valve for loading inert gas and evacuating air contained in the package.

11. A package according to claim 10, wherein the window includes upper corners provided with cutaways, and the dispensing mouth which is located in the window includes a frame positioned in the window and including tabs in concordance with said cutaways.

12. A package according to claim 10, wherein the main stiffening notches include first notches in an "X" shape, and defining upper, lower and lateral triangular zones.

13. A package according to claim 12, wherein the first notches each have a grooved section with divergent lateral walls.

14. A package according to claim 12, wherein the main stiffening notches include a set of parallel, vertically oriented secondary notches in one said lateral triangular zone opposite to a side of the package in which the dispensing mouth is fitted, extending from a corresponding vertical edge to a zone of intersection of the first notches, and wherein the secondary notches each have a curved section.

15. A package according to claim 10, further comprising additional notches in a lateral face of the package opposite to a lateral face in which the dispensing mouth is positioned, wherein the additional notches are parallel to each other.

16. A package according to claim 15, wherein the additional notches are placed in an oblique position.

17. A package according to claim 15, wherein the additional notches each have a curved section.

18. A package according to claim 10, wherein:

an upper face of the package is formed with a front upper flap, a rear upper flap and lateral upper flaps, folded in respect of lateral faces of the package and of each other, forming a flat face, in which lateral folds are bent inwards under the front and rear upper flaps; and a lower face of the package is made up of a front lower flap, a rear lower flap and lateral lower flaps, folded in respect of lateral faces of the package and of each other and outer edges of said flaps have a sealing over-extension, such that the lateral lower flaps are folded outward and folded and stuck on said lower face outside the front and rear lower flaps.

* * * * *